US008408274B2

(12) United States Patent
Dwarka

(10) Patent No.: US 8,408,274 B2
(45) Date of Patent: Apr. 2, 2013

(54) ARCHITECTURAL APPARATUS AND METHOD

(76) Inventor: Rajiva Dwarka, Boston, MA (US)

( * ) Notice: Subject to any disclaimer, the term of this patent is extended or adjusted under 35 U.S.C. 154(b) by 0 days.

(21) Appl. No.: 12/911,807

(22) Filed: Oct. 26, 2010

(65) Prior Publication Data

US 2011/0094689 A1 Apr. 28, 2011

Related U.S. Application Data

(60) Provisional application No. 61/254,915, filed on Oct. 26, 2009, provisional application No. 61/362,744, filed on Jul. 9, 2010.

(51) Int. Cl.
*A47G 5/02* (2006.01)

(52) U.S. Cl. ..... 160/264; 160/238

(58) Field of Classification Search ..... 160/238, 160/264, 348, 84.01, 349.1, 108, 89, 84.04
See application file for complete search history.

(56) References Cited

U.S. PATENT DOCUMENTS

| | | | | |
|---|---|---|---|---|
| 4,800,946 | A * | 1/1989 | Rosenoy | 160/264 |
| 5,199,479 | A * | 4/1993 | Kraeutler | 160/84.06 |
| 5,791,392 | A * | 8/1998 | Fernandez Lopez | 160/238 |
| 6,722,416 | B2 * | 4/2004 | Varley et al. | 160/264 |
| 8,113,261 | B2 * | 2/2012 | Lin | 160/84.01 |
| 8,127,821 | B2 * | 3/2012 | Hsu et al. | 160/84.01 |
| 8,186,411 | B2 * | 5/2012 | Lin | 160/84.01 |
| 2003/0127198 | A1 * | 7/2003 | Court et al. | 160/231.1 |
| 2003/0188837 | A1 | 10/2003 | Varley et al. | |
| 2010/0269985 | A1 * | 10/2010 | Hanley et al. | 160/84.04 |
| 2011/0067820 | A1 * | 3/2011 | Hsu et al. | 160/84.03 |
| 2011/0146918 | A1 * | 6/2011 | Vestal | 160/84.06 |
| 2011/0247761 | A1 * | 10/2011 | Lin | 160/84.02 |
| 2011/0247762 | A1 * | 10/2011 | Lin | 160/84.02 |

* cited by examiner

*Primary Examiner* — Katherine W Mitchell
*Assistant Examiner* — Johnnie A Shablack
(74) *Attorney, Agent, or Firm* — Lando & Anastasi LLP

(57) ABSTRACT

According to one aspect, there is provided a curtain assembly including a curtain and a plurality of rails. The curtain can be used to cover a variety of openings. The plurality of rails can be attached to and disposed horizontally on the curtain to provide rigidity to the curtain when in an open position (covering the opening). The plurality of rails can be made of two main sections, a first and a second coupled to opposite sides of the curtain. The second section can be configured to provide the lateral stability to the curtain, permitting the first section to be made of almost any material. Typically both sections are metal. The first section can also include folded over portions which wrap around the edges of the curtain. The folded over portions provide for attachment and also insure no sharp edges exist on the exterior sides of the curtain. The plurality of rails can be bonded to the curtain using an adhesive. The curtain can include prepared bonding surface to receive the rails. Both can be spaced to minimize overlap between the plurality of rails when the curtain is in a recessed position (wound around a roller).

18 Claims, 13 Drawing Sheets

ARCHITECTURAL APPARATUS AND METHOD

CROSS-REFERENCE TO RELATED APPLICATIONS

This application claims priority under 35 U.S.C. §119(e) to U.S. Provisional Application Ser. No. 61/254,915 entitled "ARCHITECTURAL APPARATUS AND METHOD," filed Oct. 26, 2009, and U.S. Provisional Application Ser. No. 61/362,744 entitled "ARCHITECTURAL APPARATUS AND METHOD," filed Jul. 9, 2010, both of which applications are herein incorporated by reference in their entirety.

BACKGROUND

Traditional window curtain installations are configured to provide for both functional and aesthetic purposes. In a conventional curtain, one functional goal is to reduce light impinging upon dwelling areas or other interior spaces coming from exterior windows. Other functions include providing for removal of the shading portions of the curtain to allow more light as desired. In some examples, this can be accomplished by winding a curtain around a roller operated by hand via a draw cord. An operator can raise or lower a curtain depending upon, for example, a desired amount of light. In other examples, the roller can be operated via a motor to raise and lower the curtain, covering exterior windows to any desired degree.

Typically, consumers select curtains based not only on the functional aspects provided, but also based on the aesthetic of the curtain. The look and feel of the curtain can be an important consideration for an appropriate curtain selection. Traditional curtains fail to incorporate non-traditional materials, and can fail to permit different aesthetics for curtain assemblies. Further traditional curtains can fail to account for the use of non-traditional materials and their impact on normal operation of a curtain assembly and the corresponding structures that implement a given curtain.

SUMMARY OF INVENTION

Accordingly there is provided a curtain assembly including a curtain and a plurality of rails. The curtain can be configured to cover an exterior opening, for example, a window in building. The plurality of rails can be attached to the curtain so they are perpendicular to a direction of operation of the curtain. The direction of operation can include the raising and lowering of the curtain to cover the exterior opening and can also include side to side motion for curtains that are installed vertically (relative to a floor of a room, for example). The curtain and the plurality of rails can be attached to a roller that upon rotation raises and lowers the curtain and the plurality of rails.

In one embodiment, the rails are constructed and arranged to provide for lateral rigidity in the curtain. A rigid curtain can insure appropriate coverage over the exterior opening both during operation of the curtain (e.g. raising and lowering) and while the curtain is in a fixed position. Further, the weight of a rail or rails can also be used to provide for vertical rigidity in the curtain. In particular, according to one embodiment, curtains that are raised and lowered into position will be pulled taught by the weight of a rail or rails that have already been extended.

The plurality of rails can be made of a plurality of sections. In some embodiments, the rail comprises two main sections, a first interior facing member and a second exterior facing member on opposite sides of the curtain. In one embodiment, the first interior member of a rail can be made of almost any material (e.g. metal, wood, plastic, etc.). The interior facing member can be selected based on appearance alone, as the material selected for the opposite exterior facing side is typically selected to provide for any requirement of rigidity and support by the curtain. The interior member and the exterior member of the rail can be adhered to their respective sides of the curtain using a variety of adhesives. In some examples, the interior facing member of the rail can also be engaged with the exterior facing member through additional attachment mechanisms. In one example, a rivet may provide for engagement between an interior facing member of the rail and the exterior facing member of the rail through the curtain. In some settings, the curtain itself can be prepared for attachment to the interior and exterior members. For example, the curtain may be constructed with a bonding surface configured to receive the plurality of rails. A bonding surface can, in some examples, be constructed on a given curtain by heat treating the curtain in a desired location. A bonding surface can be prepared that extends about both sides of a curtain. For a given length of the curtain, a plurality of spaced apart bonding surfaces can be included and configured to receive a plurality of rails.

According to one embodiment, providing for construction of a rail from a first interior member and a second exterior member permits the use of a wider variety of materials for the first interior member. Typically, the first interior member is constructed of a ductile metal of a length exceeding the width of the curtain on which it is to be installed. The additional length permits the first member to be folded about the curtain, creating a first and second folded end that wraps around the interior side of the curtain and presses against the opposite side of the curtain. The first folded end includes an interior flat portion which abuts the interior side of the curtain, a rounded portion, and an exterior flat portion that abuts the opposite or exterior side of the curtain. The interior flat portion and the exterior flat portion are constructed to compress the curtain between the interior flat portion and the exterior flat portion. The second folded end mirrors the first folded end, having a respective interior flat portion, a rounded portion, and an exterior flat portion. The interior flat portion of the second folded end and the exterior flat portion of the second folded end are constructed to compress the curtain between the respective interior flat portion and the exterior flat portion.

A space can be defined on the exterior side of the curtain between the first folded end and the second folded end of the first interior member. The second exterior member of the rail can be fixed into position by attachment to the exterior side of the curtain in the space defined between the first and second folded ends. In one example, the second exterior member is attached at a prepared bonding surface between the first and second folded ends using an adhesive. The second exterior member is typically constructed of a rigid metal. In some embodiments, the second exterior member is constructed and arranged to provide any structural support required to maintain a rigid curtain. For example, commercially available tempered and/or "full hard" stainless steel can be used to provide sufficient structural support, such that almost any material can be employed for the first interior member. In some embodiments, the second exterior member provides the structural support necessary for the curtain, and in others the first interior member can contribute to the structural support provided by a rail. In some embodiments, the members are constructed and arranged to material of sufficient strength to provide rigidity in the curtain based on low profile dimensions. In one example, the members are constructed of metal with a height of 5/16 inches by a width of 0.020 inches, although other dimensions can be used.

In some embodiments, the second exterior member is constructed to abut the first and second folded ends of the first interior member. In other embodiments, the second member can be attached to the first interior member at the first and/or second folded ends. In another embodiment, attachment mechanisms can also be used to attach the first interior member to the second exterior member. In one example, a rivet can attach the first interior and second exterior member to form the individual rails of the plurality of rails attached to the curtain.

The spacing of the rails, and/or the prepared bonding surfaces on the curtain can also be configured to assist in the operation of the curtain assembly. In particular, the placement of the rails can be arranged to minimize overlap of the plurality of rails as the curtain is wound around a roller. Likewise, the dimensions of the rails can be selected to facilitate operation of the curtain assembly. For example, The placement of the plurality of rails and/or the bonding surfaces on the curtain to which they are attached can be tailored to a specific dimension of the plurality of rails to permit the rails and curtain to be wound over the roller with minimal overlap of the rails. For example, based on the width of the plurality of rails, the distance between the rails and/or bonding surfaces can be tailored to permit minimal overlap in the plurality of rails when wound around a roller. In another example, the spacing of the rails and the circumference of a roller can be tailored to accommodate the rails in a wound position. In another embodiment, the circumference of the roller can be configured to permit winding of the curtain and the plurality of rails for rails of a given width and spacing so as to minimize overlap of the plurality of rails when the curtain is retracted.

According to one aspect of the present invention, a curtain assembly is provided. The curtain assembly comprises a curtain selectably moveable between an open position and a recessed position, and a plurality of rail assemblies attached to the curtain, wherein the plurality of rail assemblies are constructed and arranged to provide lateral stability in the curtain when the curtain is in an open position, and wherein the plurality of rail assemblies further comprise: a first member attached to a first side of the curtain, the first member constructed and arranged to include a first folded portion, wherein the first folded portions comprises: an interior flat portion, an exterior flat portion, a rounded portion connecting the interior flat portion and the exterior flat portion, wherein the curtain is compressed between the interior flat portion and the exterior flat portion, and a second member attached to an opposite side of the curtain.

According to one embodiment of the present invention, the first member further comprises a second folded portion wherein the second folded portion comprises a second interior flat portion, a second exterior flat portion, a second rounded portion connecting the second interior flat portion and the second exterior flat portion, wherein the curtain is compressed between the second interior flat portion and the second exterior flat portion. According to another embodiment of the invention, the curtain assembly further comprises a roller attached to the curtain, wherein the roller is constructed and arranged rotate thereby transitioning the curtain between the open position, wherein the curtain is extended from the roller and the recessed position, wherein the curtain is wound around the roller. According to another embodiment of the invention, the first member and second member of the plurality of rail assemblies are constructed of metal.

According to one embodiment of the present invention, the second member of the plurality of rail assemblies is constructed to provide the lateral stability in the curtain when the curtain is in the open position. According to another embodiment of the invention, the second member of the plurality of rail assemblies is constructed to provide substantially all of the lateral stability in the curtain when the curtain is in the open position. According to another embodiment of the invention, the first member is constructed and arranged of a ductile metal. According to another embodiment of the invention, the first member is constructed and arranged to provide substantially no lateral stability to the curtain. According to another embodiment of the invention, the first member and the second member of the plurality of rail assemblies is attached to the curtain using an adhesive.

According to another embodiment of the invention, the curtain further comprises a plurality of bonding surfaces configured for attachment to the plurality of rail assemblies. According to another embodiment of the invention, the plurality of rail assemblies are constructed and arranged to include a spacing between each of the plurality of rail assemblies, wherein the spacing is configured to minimize the overlap of each of the plurality of rail assemblies when the curtain is wound around the roller in the recessed position.

According to one embodiment of the present invention, the curtain further comprises a plurality of bonding surfaces configured for attachment of the plurality of rail assemblies, wherein the plurality of bonding surfaces are constructed and arranged to include a spacing between each of the plurality of bonding surfaces, wherein the spacing is configured to minimize the overlap of each of the plurality of rail assemblies when the curtain is wound around the roller into the recessed position. According to another embodiment of the invention, the first member of the plurality of rail assemblies is constructed and arranged of a length exceeding the width of the curtain. According to another embodiment of the invention, the exterior flat portion and at least part of the rounded portion are defined by a portion of the length of the first member that exceed the width of the curtain.

According to another embodiment of the invention, the second member of the plurality of rail assemblies is configured to abut the first and second folded portions of the first member. According to another embodiment of the invention, the second member of the plurality of rail assemblies is attached to the first member. According to another embodiment of the invention, the curtain assembly includes a coupling device configured to attach the second member and the first member. According to another embodiment of the invention, the roller is constructed and arranged with mating surfaces, wherein the mating surfaces are constructed and arranged to mate with the plurality of rail assemblies when the curtain is in the recessed position.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. Where technical features in the figures, detailed description or any claim are followed by references signs, the reference signs have been included for the sole purpose of increasing the intelligibility of the figures, detailed description, and/or claims. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. In the figures:

DETAIL DESCRIPTION

Figure 1B:
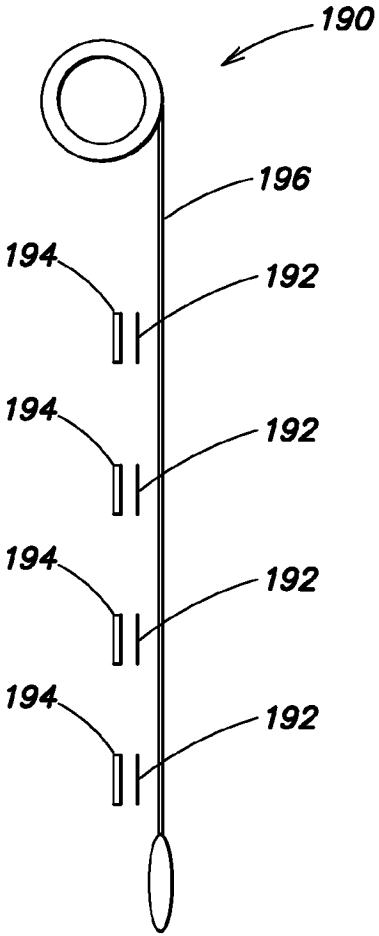
FIGS. 1A-D illustrate example views of example curtain shade assemblies, according to aspects of the present invention.
Figure 1A:
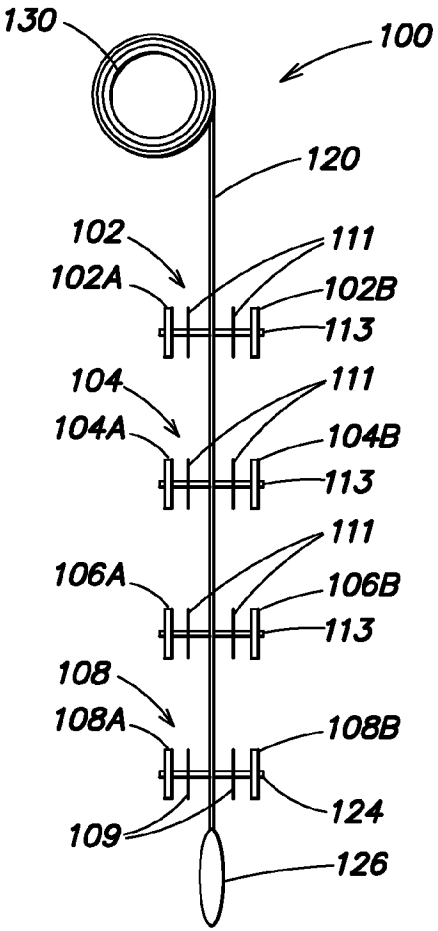

According to one aspect, presented are novel integration of various structural elements into window curtain assemblies and window shade design models. In particular, according to some embodiments, metal banding is incorporated into a fabric reel window shade in a unique manner. The difficulties associated with integrating metal banding and the various structural elements of the curtain assemblies can be overcome according to some embodiments discussed herein. Notably, various structural elements introduced in the fabric curtain portion of the window shade apparatus present difficulties when employing a traditional reel based mechanism for raising and lowering the shade.

According to another aspect, a manufacturing process and machinery that can be used to generate some embodiments of novel window shades are also presented. Other features and aspects will become apparent with reference to the figures and related description, which provide additional detail with respect to some embodiments of the present invention.

According to another aspect, a curtain assembly includes a curtain and a plurality of rails attached to the curtain. The plurality of rails can be constructed of metal as described in greater detail below. In some embodiments, the plurality of rails are constructed and arranged to provide for the use of a ductile metal for an interior facing section, while providing structural support to the curtain by a rigid metal exterior facing section. The combination permits the use of various materials for the interior facing section. In some embodiments, the combination allows for aesthetic effect to govern the selection of the material used for the interior facing portion of a rail. In other embodiments, the combination further permits construction of the first interior section so as to minimize the amount of material needed for the first interior section. In one example, the first interior section can be constructed of an expensive metal. The amount of metal required for the first interior section can be reduced by relying on the structure provided by the second exterior section to hold the curtain in place with little or no support from the first interior member. Additional benefits can be derived from the used of curtain assemblies including the plurality of metal rails as discussed in greater detail below.

Shown for example in FIG. 1, is one embodiment incorporating some aspects of the present invention. Curtain shade assembly 100 is constructed of a roll tube 130, which upon rotation winds a curtain 120 off of or onto the roll tube 130. The curtain 120 is attached to horizontal elements 102-108. The horizontal elements are constructed and arranged to hold the curtain 120 taught when the curtain is off of the roll tube 130. According to one embodiment, curtain 120 can be constructed of fabric (or other materials).

Horizontal elements 102-108 provide the structural support to hold the curtain under tension. Tension is maintained such that the curtain when off of the roll tube can be configured to be flat or substantially flat, shown for example in FIG. 1D. One should appreciate that FIGS. 1A-E are shown by way of example. For example, horizontal elements 102-108 can be constructed of metal banding having a height of 5/16". The height of the metal banding can dictate other structural features of the curtain assembly 130. In particular, according to some embodiments, the spacing of the horizontal elements 102-108 can be tailored to facilitate the operation of the curtain assembly 100 as the curtain is wound around roll tube 130. For example, the spacing of the horizontal elements can be arranged to provide for minimal overlap of the horizontal elements 102-108 when the curtain is rolled about roll tube 130. Shown in FIG. 1C is an example of a curtain 152 wound around roll tube 159, with a plurality of horizontal elements 155-158 arranged such that overlap between the horizontal elements is minimized. In some examples, the horizontal elements can be configured to align adjacent to each other as the curtain is wound.

In some embodiments, the horizontal elements 102-108 each comprise a pair of respective metal members A and B. The metal members 108 A-B are typically constructed and arranged of metals of varying rigidity. In some embodiments the metal for an exterior facing side is selected to provide rigidity to curtain. The thickness dimension of exterior facing metal member can be varied depending on a required rigidity, for example to hold the curtain under tension, such that the curtain remains substantially flat when off of the roll tube 130. One should appreciate that different levels of rigidity are required based on the details of a specific installation. In some examples, little rigidity is required and thin members (e.g. metal members 108A-B may be used to sandwich the curtain 120 between them). Shown at 108A and 108B are two metal members applied to opposing sides of a curtain 120. The metal bands can be constructed to facilitate operation of the assembly, in one example, by having widths of 0.020 inches (+/−0.009 inches). In other examples, different width and/or heights can be employed.

In some processes for producing the window shade, an adhesive layer 109 is applied to the metal members 108A-B to fix the position of the members so other attachment mechanisms can be included. For example, adhesive tape can be used at 109 to fix the position of the metal members 108A-B so that another attachment mechanism can be employed. In another example, the attachment mechanism includes a rivet, 124. Other attachment mechanisms may be employed. In other examples, the adhesive can be the only attachment mechanism to fix the member 108A and 108B to the curtain 120. Each horizontal element can be constructed in a manner similar to the horizontal element 108, with each horizontal element 102-106 having their own respective inter and exterior metal members 102A-B, 104A-B, and 106A-B. Further each horizontal element and the members A and B that comprise them can be attached to the curtain 120 using an adhesive applied at 111. In some embodiments, additional attached mechanisms can be employed. In one example, rivets 113 may be used to fix the members together.

One should readily appreciate that the attachment mechanism used should not impede the operation of the curtain. In one embodiment, the attachment mechanism is configured to be flush with the metal members, permitting operation of the curtain (raising and lowering) without catching the fabric of the curtain. In one example, a rivet is employed so that the rivet is flush with the metal members 108A-B.

Some implementations can include horizontal elements of thickness less than 0.1 of an inch for each member pair, providing an overall thickness of up to 0.2 inches. Other embodiments can use material of differing thicknesses for each element, including different thicknesses for an interior facing member and an exterior facing member among other examples. Thin implementations can be used, for example, with expensive material and/or where the primary purpose of the elements is to contribute to the overall design of the window shade apparatus.

Roll tube 130 operates to raise and lower curtain 120 once the assembly 100 is installed. According to some embodiments, the spacing of the horizontal elements is important to the proper functioning of the window shade. Typically, the roll mechanism must be configured to incorporate the length of the curtain 120 and the thickness of each individual horizontal element. Appropriate spacing between the horizontal elements prevents overlap permitting a smaller overall chamber for the curtain 120 and roll tube 130, for those embodiments employing an outer chamber to conceal the roll and curtain from view (not shown). Additionally, the spacing between horizontal elements provides for a smaller profile for some shade embodiments that do not conceal the roll tube 130 and curtain 120 when in its upper or recessed position.

Shown at 150 is a window shade assembly 150 with curtain 152 partially recessed. Window shade assembly 150 illustrates a wound position of the curtain 152, and the nesting of the horizontal elements 155-159, so that the plurality of horizontal elements align in adjacent position, minimizing overlap of the horizontal elements. In some embodiments, the horizontal elements will overlap, but typically, they are adapted and configured to occupy adjacent positions until the adjacent positions are filled, and then the next horizontal member will occupy an overlapping space with any remaining elements occupying positions adjacent to the first overlapping element. Thus according to some embodiments, the horizontal members will occupy adjacent positions until the diameter of the roll tube 160 and curtain is filled, and then a next circle of adjacent space will be filled and so and until the curtain and any horizontal members are entirely retracted. According to one example, spacing considerations can be determined by accounting for the tube diameter (alternatively by radius or circumference) and the width dimension of the horizontal elements. One should appreciate that different spacing dimensions may be employed.

Referring again to FIG. 1A, shown as part of shade 100, is pocket 126. Pocket 126 can provide a conventional style pocket defined by an end of the curtain material folded over. Typically in a conventional style shade, pocket 126 would have an element inserted to provide some stability/rigidity and weight to assist in the operation of the window shade assembly 100. Often the weight is sized to assist in the opening of the shade or to assist in removing the curtain 120 from the roll tube 130. In one alternative, instead of generating a pocket of the curtain material, an end horizontal element can be installed.

Shown in FIG. 1B, at 190 is one alternative implementation of a window shade assembly. Window shade assembly 190 incorporates adhesive tape at 192, or other adhesive layer (glue, epoxy, etc) of sufficient strength to hold metal banding at 194 directly to the fabric of the curtain 196. One should appreciate that the adhesive layer must be strong enough not only to hold the metal banding in place but also to withstand the normal operation of the curtain (opening and closing—repeatedly) which will put additional stress and strain on the bond between the metal banding and the fabric of the curtain, in the embodiments where the adhesive layer is the only attachment mechanism.

Figure 1D:
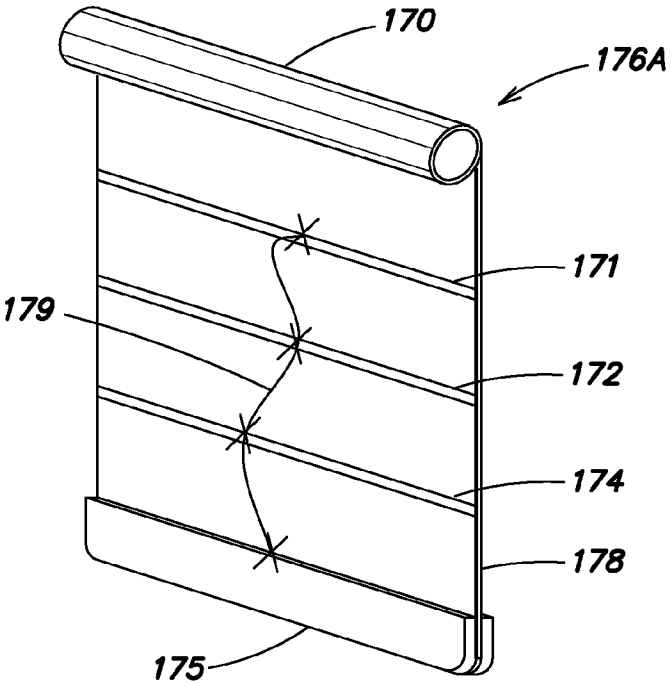
Figure 2B:
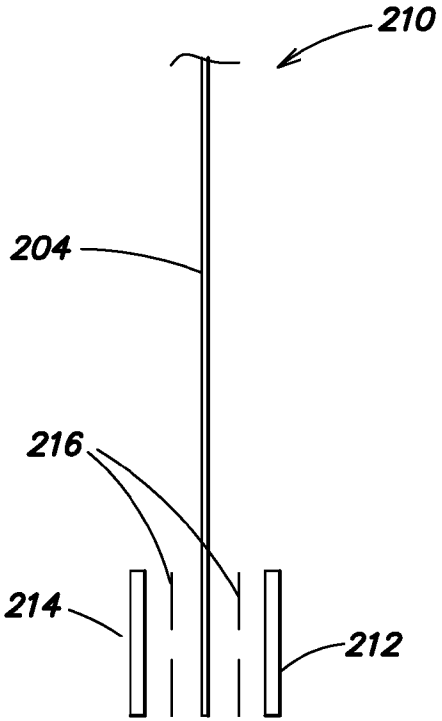
FIGS. 2A-B illustrate examples of an end horizontal element, according to aspects of the present invention.
Figure 2A:
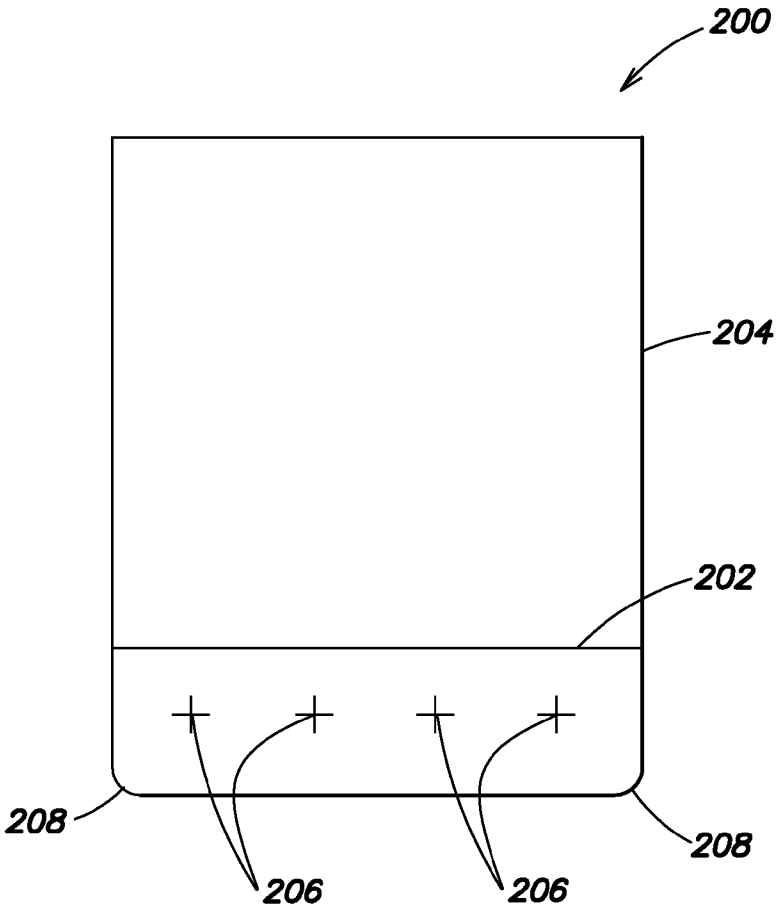
Figure 2C:
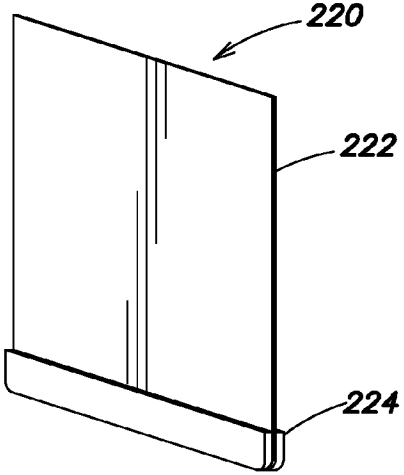

FIGS. 2A-B illustrate examples of an end horizontal element and specific features of the examples. According to some embodiments, the front and back of each horizontal element can be constructed of different materials. In some embodiments, the material for the front and back of the horizontal elements are uniform; in others, different material may be used for the front and back portions. The size of the various horizontal elements can vary even within an individual shade, for example in FIG. 1D is curtain assembly 170. Roll tube 176A is attached to curtain 178. Internal horizontal elements 171-174 feature shorter widths than the end horizontal element 175. In one embodiment, curtain assembly 170 can include wire attachment 179 between the horizontal elements 171-175. Wire attachment 179 can be made of string, rope, wire, or other flexible and resilient material. Wire attachment 179, as shown, serves to guide the opening of the curtain and assists in its retraction.

Figure 1E:
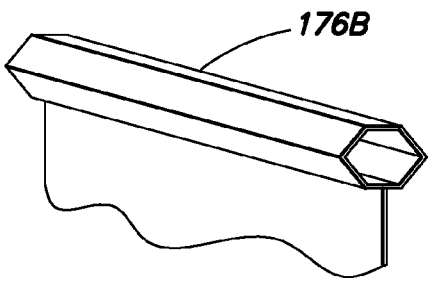
FIG. 1E illustrates an example of roller used in a curtain shade assembly, according to aspects of the present invention.
Figure 1C:
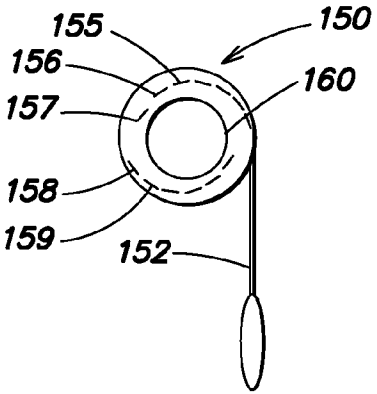

In another embodiment, FIG. 1E, roll tube 176B may be constructed specifically for the curtain and associated horizontal elements. Instead of employing a circular cylinder, other arrangements may be used to provide for improved communication between the roll tube 176B and the horizontal elements. In this example, a hexagonal roll tube 176B can be employed with a six horizontal element curtain. In other embodiments the number of sides may vary according to the number of horizontal elements. For example, octagonal roll tube can be employed for a curtain with 8 horizontal elements. Although one should appreciate that in some embodiments, it is not necessary to count the end horizontal element as it may not be wound on the tube. Further, in some embodiments, the end horizontal element can feature rounded edges and may also include additional structural elements (as shown by example in FIGS. 2A-E).

Figure 2D:
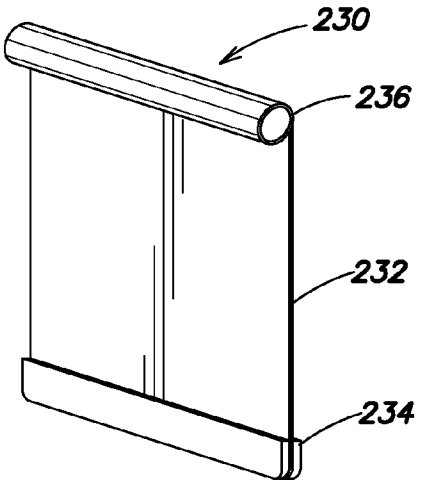
Figure 2E:
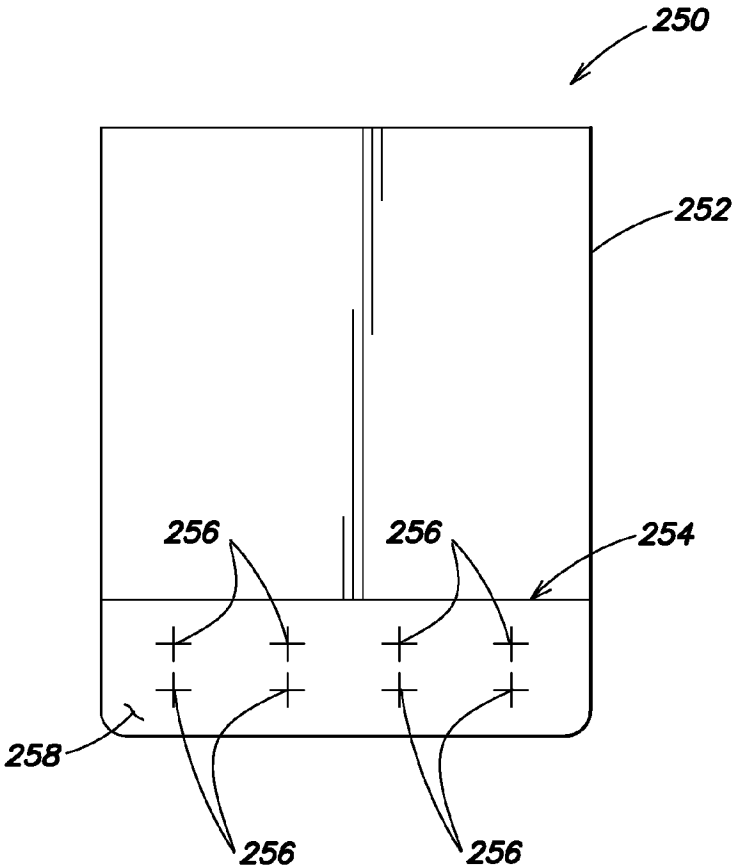

Referring to FIG. 2A, shown is one embodiment of an end horizontal element 202 attached to the base of a curtain 204, forming a curtain assembly 200. Shown by example in sided view at 210, the end horizontal element 202 can be constructed of an interior member 212 and an exterior member 214 which are fixed to curtain 204 using an adhesive, for example, adhesive tape at 216. Returning to the front view, 200, the end horizontal element can include additional attachment mechanisms to attach the interior member 212 to the exterior member 214 and the curtain 204. As shown, rivets can be employed at 206 to attach the members 212-214 to the curtain 204. According to some embodiments, an end horizontal element can include additional features. For example, the end horizontal element can include rounded edges at 208 to improve operation of the curtain assembly 200. Rounded edges 208 can facilitate the operation of the curtain assembly by preventing the end horizontal element from catching or damaging surfaces adjacent to an installed position. For example, the curtain assembly can be installed in a window box of a conventional window (not shown). Rounded edges 208 can assist in preventing the horizontal element 202 from catching or damaging the surfaces of the window box. Shown at 220 is a perspective view of a curtain assembly including a curtain 222 and an end horizontal element 224. Shown in FIG. 2D is a curtain assembly 230, including a curtain 232 and an end horizontal element 234 attached to a roller. Shown in FIG. 2E, is an example curtain assembly 250, including a curtain 252 and a horizontal element 254 employing an additional row of attachment mechanisms. Shown at 256 are rivets employed to attach an interior member 258 of the end horizontal element 254 to an exterior member (not shown). End horizontal elements can be constructed of varying thickness and height depending on a particular installation. Additional attachments may be required depending on the size of the dimensions of the horizontal elements, for example, as shown in FIG. 2E.

Figure 3B:
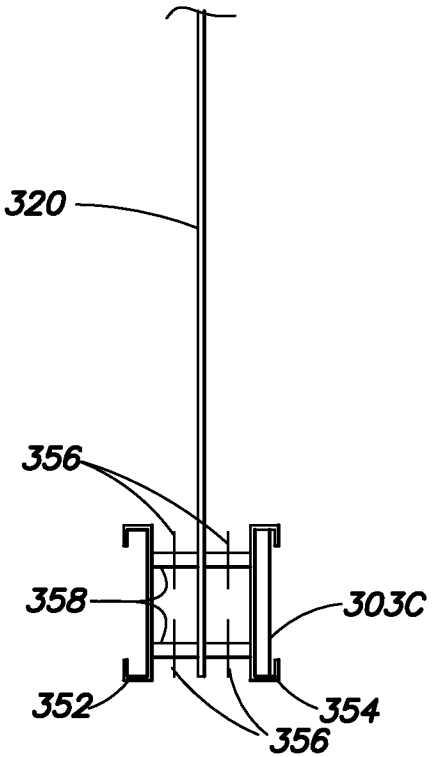
FIGS. 3A-D illustrate examples of an end horizontal element for use in a window shade assembly, according to aspects of the invention.
Figure 3A:
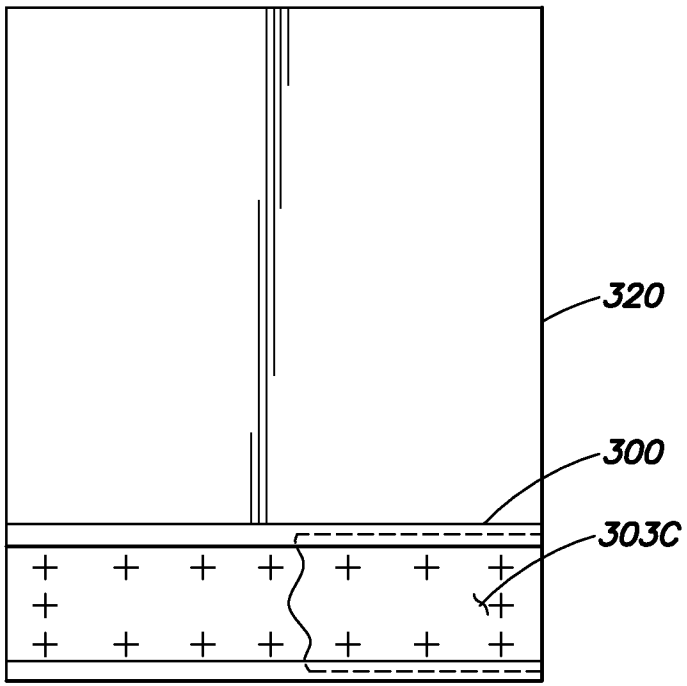
Figure 3D:
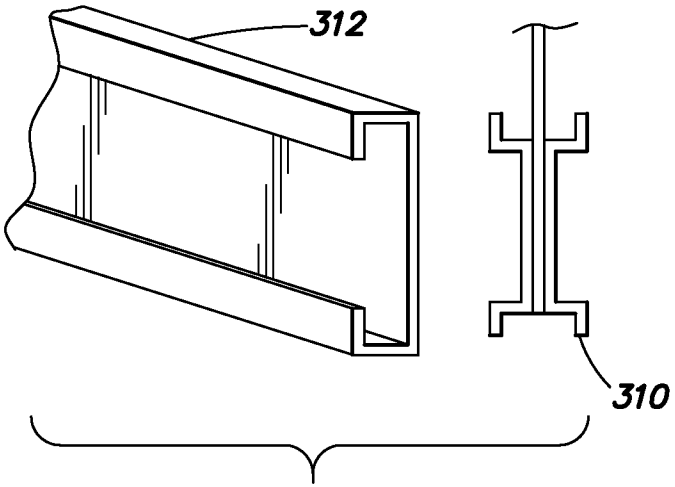
Figure 3C:
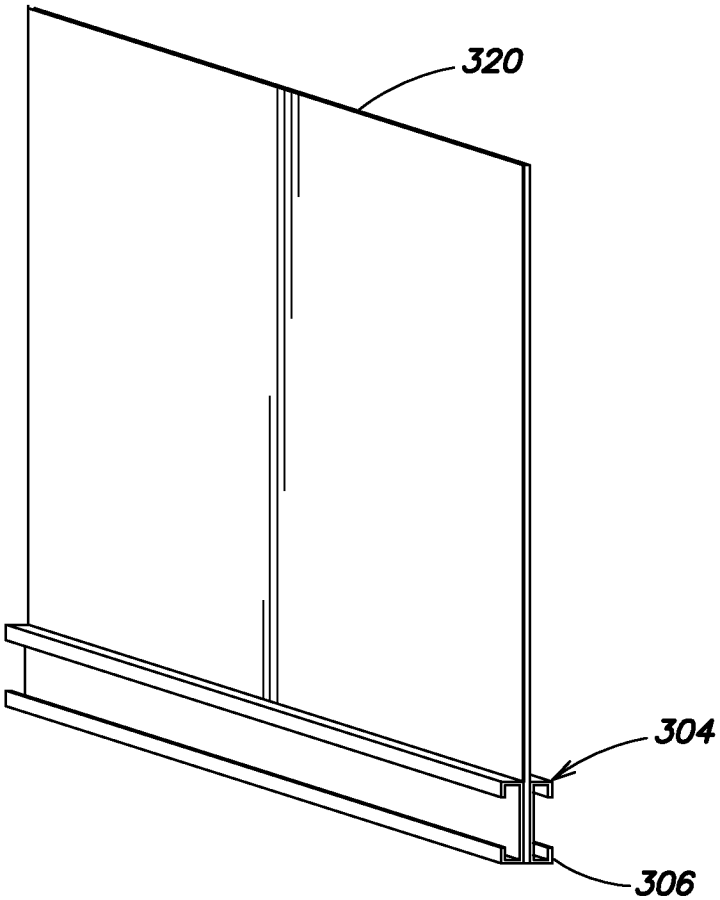

With reference to FIGS. 3A-C, shown is another embodiment of an end horizontal element 300 from a front view, FIG. 3A, a perspective view, FIG. 3C, and a side view FIG. 3B. According to one embodiment, the end horizontal element 300 can include additional structural elements. The additional structure elements (e.g. 304, FIG. 3C showing a perspective view of 300), form a receiving channel (e.g. 306) for receiving plates (303C, FIG. 3B showing a side view of horizontal element 300). Plates (e.g. 303C) can be constructed of different materials permitting signage to be attached to various embodiments of a curtain assembly. In a commercial installation, this may permit custom naming and even advertising. In one embodiment, the receiving member (e.g. 304) and receiving channel (306) permits introduction and replacement of custom designed plates. This permits the overall appearance of the window shade to change at the will of the owner/operator. In another example, the receiving member (e.g. 310—FIG. 3D) defines an exterior channel and plate 312 is received by and hides structure 310 of the end horizontal element from view. Plate 312 and/or 303C may be custom designed, colored, and include any ornamentation desired. Referring to FIG. 3B, shown are structures that can be used in an end horizontal element 300. An interior member 352 can be attached to a curtain 320. An exterior member 354 can be attached to an opposite side of the curtain 320. In some examples, an adhesive can be used to bond the members 352-354 to the curtain 320. For example, adhesive tape may be applied at 356 to bond the members and curtain. Additional attachment mechanisms can be employed. In one example, rivets may be employed at 358 to attach members 352-354 to the curtain 320 and to each other.

Figure 5:
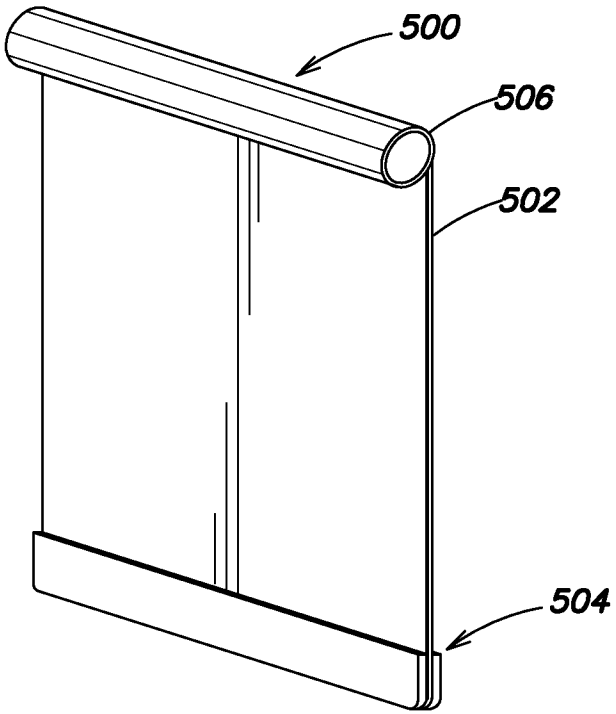
FIG. 5 illustrates an example of a window shade apparatus, according to aspects of the present invention.
Figure 4:
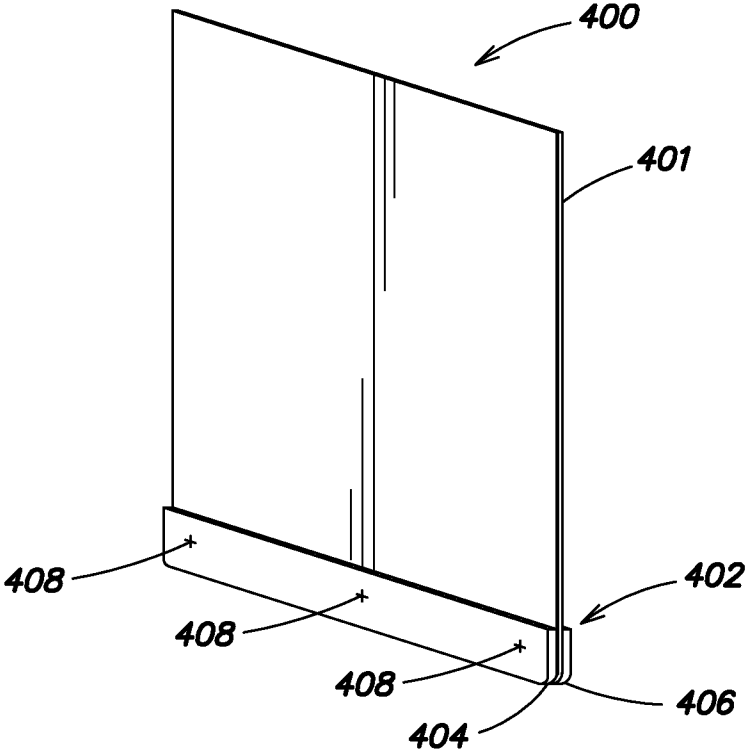
FIG. 4 illustrates an example of a window shade apparatus, according to aspects of the present invention.

FIG. 4 further illustrates an additional example of window shade apparatus 400, comprising a fabric curtain 401 and an end horizontal element 402. The end horizontal element 402 is constructed of a front metal bar 404 attached to a back metal bar 406 by rivets at 408. The window shade apparatus 400 is configured to be installed on a roller also referred herein as a roll tube (not shown). FIG. 5 illustrates another embodiment of a window shade apparatus 500, comprising a curtain 502 and an end horizontal element 504 installed on a roller 506.

Figure 6B:
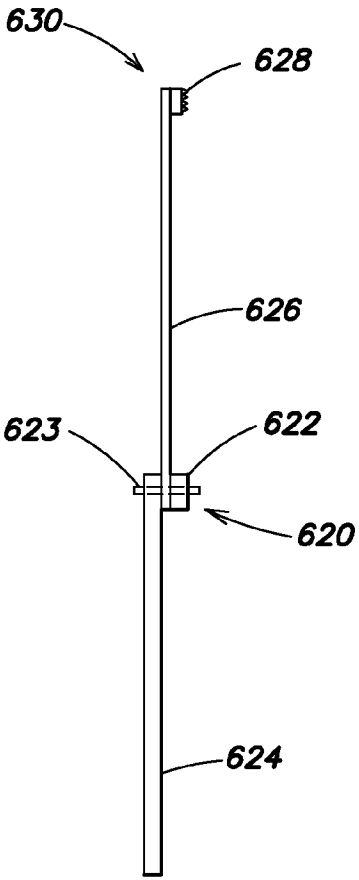
FIGS. 6A-D illustrate example window shades apparatuses, according to aspects of the present invention.
Figure 6A:
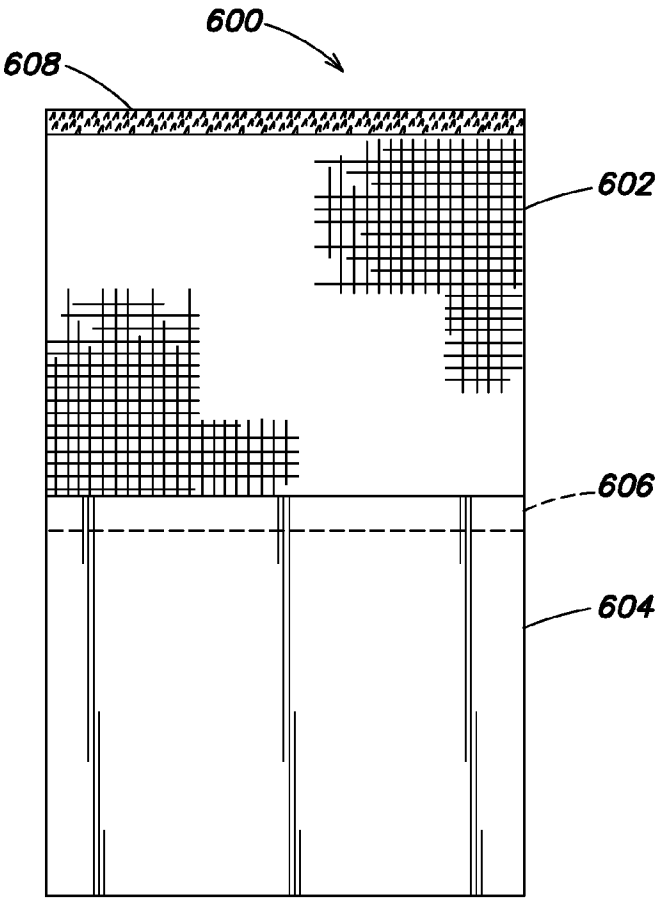

FIG. 6A illustrates another example of a window shade apparatus for use with tracked operation of the window shade/curtain as opposed to an installation with a roller or roll tube. Shown at 600 is one panel of an example shade apparatus. Shade apparatus 600 includes an upper fabric panel 602 a lower metal panel 604, attachment band 606 and attachment layer 608 for connecting shade 600 to a track. In one embodiment, attachment layer 608 includes hook and loop fastener, known commercially as velcro, to attach to an opposed velcro strip installed on a track device. A side view of a shade apparatus is shown at 630, FIG. 6B. Shown at 620 is an example attachment band. As shown a metal band 622 and a metal plate 624 sandwich fabric panel 626 to attach the components of the shade apparatus 630. In some examples, rivets can be employed at 623 to attach the metal band 622, fabric panel 626 and metal panel 624. Typically the rivets are constructed and arranged to be flush with the metal panel and metal band 622. At 628 an attachment layer is configured to attach the shade apparatus 630 to a track (e.g. 672, FIG. 6C) for operating the shade apparatus between open and closed positions.

Figure 6D:
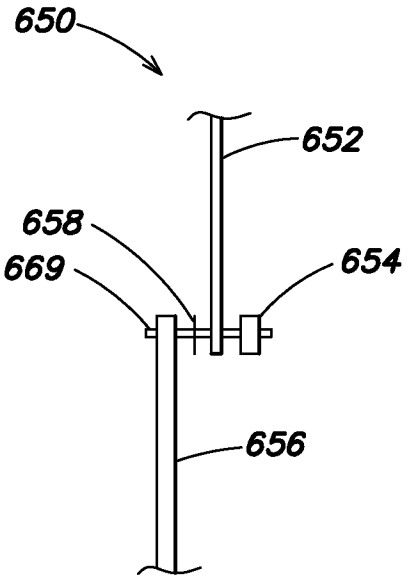

Shown at 650, FIG. 6D is another implementation of a shade apparatus. Shade apparatus 650 is constructed of an upper fabric panel 652, although other materials can be employed for panel 650 (e.g. plastic or other synthetic fibers can be used in place of fabric panel 652). Metal band 654 is constructed attach the metal panel 656 to the fabric panel 652. The metal band 654 can be constructed of various materials of varying thickness. In one example, stainless steel can be employed of a thickness up to 0.020 inches, although other materials and dimensions can be employed. In some embodiments, variation of the thickness dimension is permitted. In some embodiments, variation can include +/−0.009 inches. In some examples, a greater variation can be used with thicker or thinner bands. Metal panel 656 can be attached to the fabric panel 652 using an adhesive at 658. In one example, adhesive tape can be employed to fix the panels 652 and 656 in place. Additional attachment mechanisms can be employed to attach the panels 652 and 656 to each other for operation. In particular, rivets can be employed at 669 to provide for attachment of the panels. Further, rivets at 669 can be constructed to engage the metal band 654 so that panels 652 and 656 are attached to each other and the metal band 654 at 669 to provide for increased structural support.

Figure 6C:
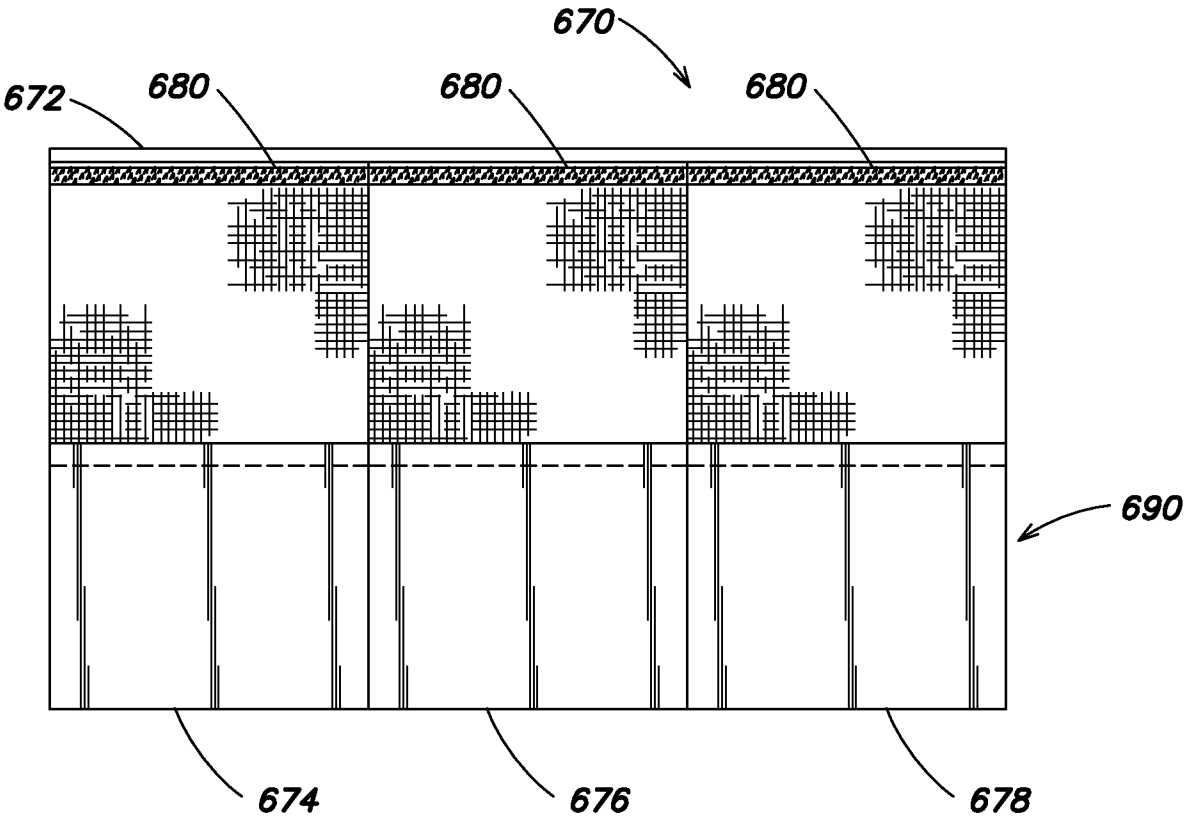

Shown in FIG. 6C is a multi-panel shade apparatus 670. Multi-panel shade apparatus can be comprised of individual shade apparatuses (e.g. 600, FIG. 6A) which are attached to an overhead track 672 at attachment layer 680. The overhead track 672 can be configured to permit the panels 674-678 to glide over each other into a closed position 690, wherein the apparatus 670 covers an external opening. The track 672 can also be further configured to permit the panels 674-678 to glide over each other to achieve an open position (not shown), wherein the external opening (e.g. sliding glass doors or windows) is no longer covered.

Figure 7A:
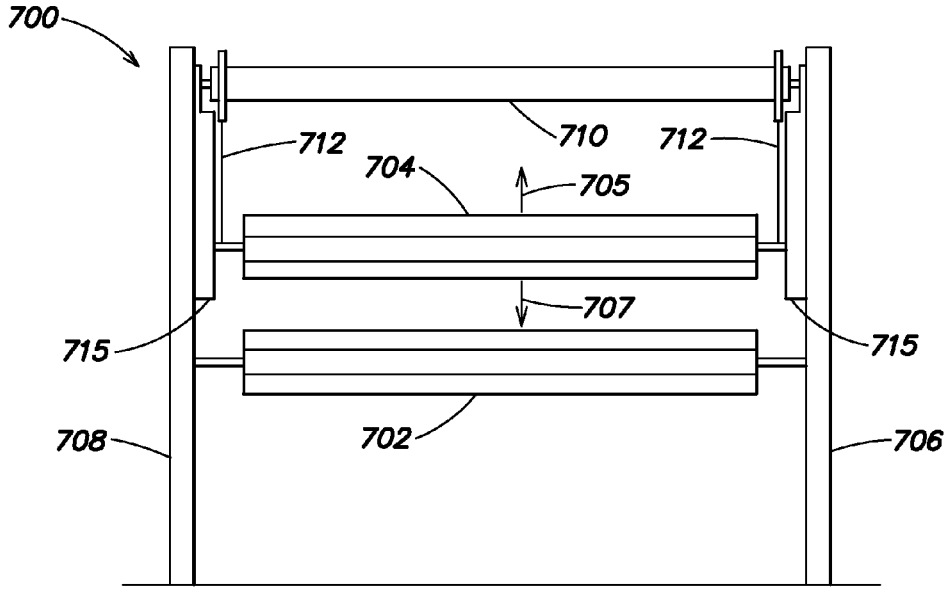
FIGS. 7A-C illustrate examples of systems for manufacturing window shade apparatuses and curtain assemblies, according to aspects of the present invention.
Figure 7B:
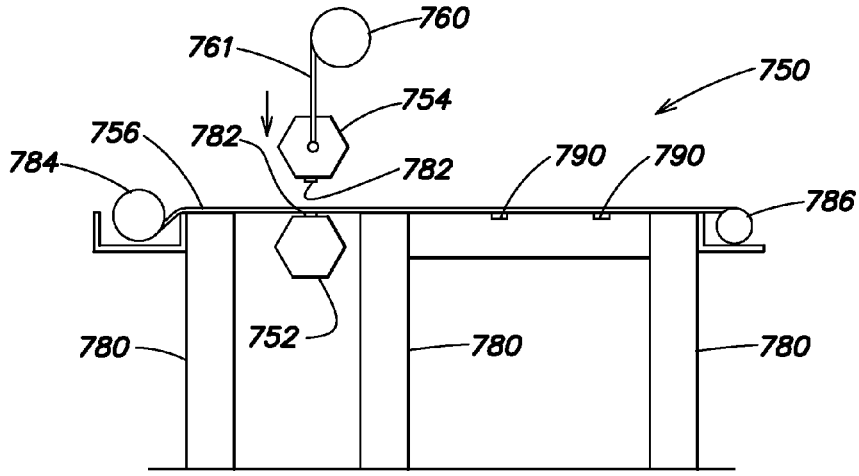

Shown in FIG. 7A, is an example system 700 for the manufacture and assembly of window shades/curtains according to various aspects of the invention. Rollers 702 and 704 may be installed on a table or may be operatively connected to another surface. A curtain 756 (FIG. 7B) can be fed through the space defined between 702 and 704 and at various intervals the rollers 702-704 can be pressed together to fix banding to the curtain as appropriate. The curtain can be made of fabric or other material. Lifting system 700 typically holds an upper roller 704 above any surface that curtain is being passed over, and the upper roller 704 can be configured to move in the directions indicated by arrows 705 and 707 to be pressed against a lower roller 702. The upper roller 704 can also be configured to operate within the confines of a track 715 attached to or constructed within supports 706-708. Although one should appreciate that the upper roller 704 could be fixed in other embodiments, with the lower roller 702 being lifted to press the two rollers together.

Lifting system 700 includes rollers 702-704 which are attached to supports 706-708. In one embodiment, lift tape 712 is used to attach upper roller 704 to a lifting bar 710. In other examples rope, wire, or other attachment devices may be used to attach the upper roller 704 to the lifting bar 710. In some implementations, lifting system 700 includes a lift arm and press mechanism (not shown) that permit the lifting and lowering of upper roller 704. A lift arm can be provided to rotate lifting bar 710. In some embodiments, rotation of the lifting bar rotates the attachment devices at 712, thereby raising and lowering the upper roller 704. In other embodiments, a press mechanism can be included. A press mechanism can be constructed with hydraulic devices to provide sufficient force to press metal bands to together and at the same time rivet the metal bands to either side of a curtain 756. In another embodiment, the rollers are configured for manual operation and an operator can turn the rollers by hand as a curtain is being fed through the space between the rollers. In some examples, the rollers are linked so that the turning of one causes the same turn in the other. In other embodiments, the rollers may be used to pull the fabric across the assembly table by their operation.

A side view of an example assembly table is shown at 750. Excluded from side view 750, are supports for rollers 752 and 754. Lower supports 780 provide a platform (e.g. a table) on which a curtain 756 (e.g. a fabric curtain) is passed between rollers 752-754. At appropriate intervals, upper roller 754 is lowered to press metal bands 782 to the curtain by pressing against a lower roller 752. In some embodiments, upper roller 754 is lowered by operation of a lifting bar 760. Lifting bar can be configured to raise and lower upper roller 754 upon rotation through connection 761.

In some embodiments, rivets are inserted into the metal bands 782 after attachment to the curtain to complete the attachment (not shown). In one example, two metal bands 782 are attached to the curtain 756 so as to form a horizontal element as discussed with respect to FIGS. 1A-E. In some other embodiments, the metal bands are attached to the curtain using only an adhesive. The curtain and adhesive attached metal bands may be further processed to incorporate further attachment devices (e.g. rivets) or may be incorporated into finished shades/curtains directly. Rollers 784 and 786 can be configured to feed curtain 756 through the assembly table 750. Further rollers 784 and 786 can be configured to accept the completed curtain and metal member assembly. In some example, a roller or a roll tube to be used in a curtain assembly may be used at either 784 or 786 to accept a completed curtain with attached metal bands. At 790, shown are channel structures built into the assembly table 750. Channels 790 are configured to assist in the proper placement of metal bands on the curtain with an appropriate spacing. The distance between 790 and the rollers can be configured based on the specific implantation details for a particular curtain assembly.

Figure 7C:
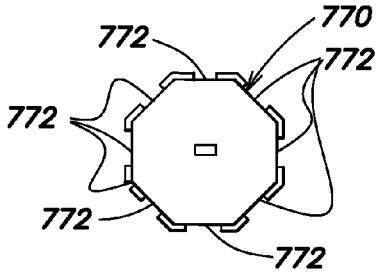

Shown at 770, FIG. 7C, is one example of a roller seen from the side that can be incorporated as either roller shown in examples 700 and 750. Although one should appreciate that different configurations of the roller 770 can be used. Roller 770 is shown as an example for a roller used to manufacture a curtain/shade assembly designed with 8 horizontal elements. Although the example shown can be readily used to fabricate a curtain/shade with additional or fewer horizontal elements. According to one example, rollers 702-704 can be readily replaced with rollers having different configurations, permitting switches between curtain styles and numbers of horizontal elements. Shown at 770, is an example roller with channels 772. The channels 772 define a space for inserting, typically, metal bands (e.g. 782, FIG. 7B). In one implementation, metal bands are inserted channels 772 in both upper and lower rollers, and as a curtain (e.g. a fabric curtain) is fed onto the assembly table, the rollers turn to bring the metal bands into contact with the curtain. An adhesive can be applied to the metal bands or to the curtain, and upon contact the metal bands adhere to the curtain forming the front and back face of a horizontal element as discussed above.

Figure 8:
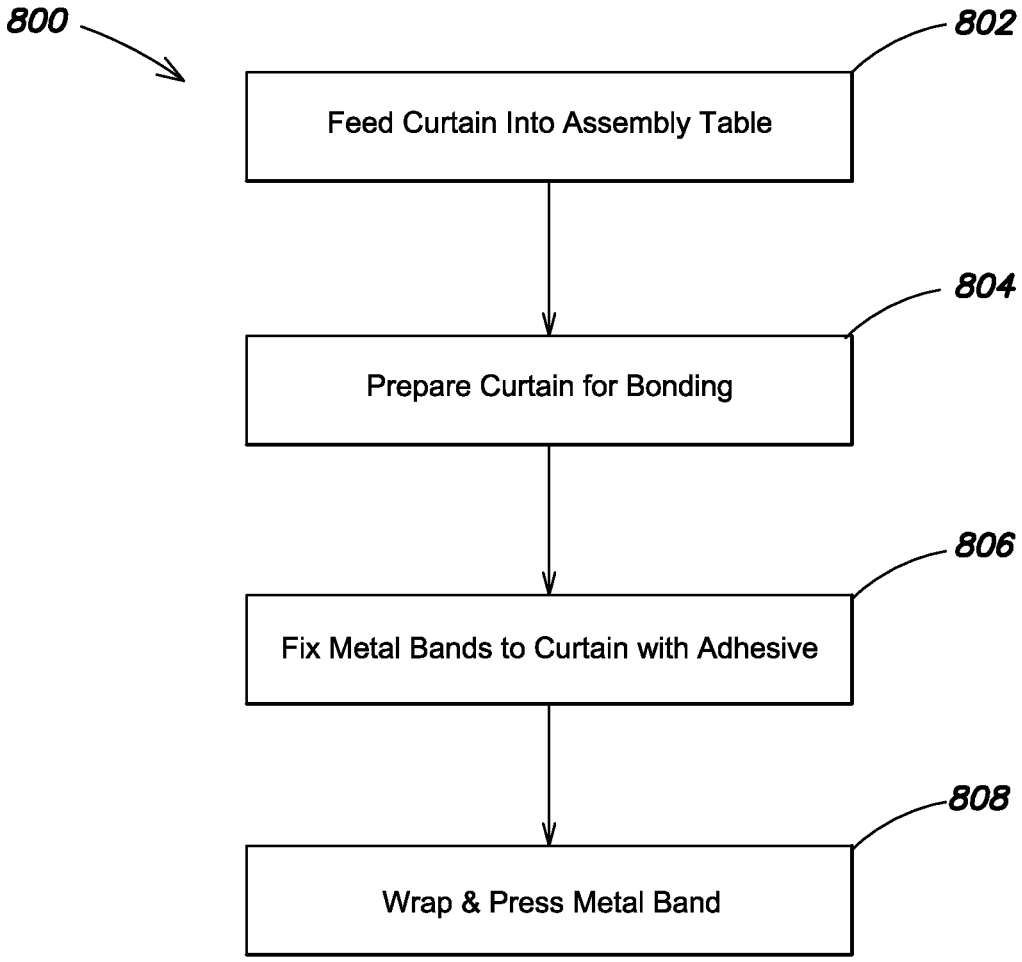
FIG. 8 illustrates a process for fabricating a curtain, according to aspects of the present invention.

According to another aspect, a process for fabricating a curtain with metal horizontal elements is provided. The horizontal elements comprise a front metal band and a rear metal band that can be adhered to the curtain to create the horizontal element. Process 800, FIG. 8, begins with feeding the curtain material into an assembly table at 802. One example assembly table is configured with matched rollers, that when operated pull the curtain through the assembly table and facilitate placement of the front and rear metal bands at appropriate spaces on the curtain.

The rollers are further configured to press the front and rear metal banding to the curtain as it is pulled through the assembly table. According to one embodiment, prior to pressing the metal banding to the curtain, the curtain is prepared for the attachment at 804. In one embodiment, preparation of the curtain typically involves applying a heating element to the curtain. Depending on the material being used, the heating element can be used to melt the curtain material to prepare it for bonding with the metal bands. In one alternative, heating portions of the curtain insures that oils and other materials that would interfere with an adhesive bond are removed from the curtain. Heating elements can be applied to both surfaces of the curtain or in the alternative one surface of the curtain. The heated portions of the curtain can be configured to create bonding surfaces specially constructed to receive metal bands used to form horizontal elements of a curtain assembly. In some embodiments, the heating elements are applied under pressure to create a bonding surface on the curtain. In some implementations, the application of the heating elements melts the curtain material providing for the bonding surface. In other implementations, the curtain material is flattened by applying pressure and heat to provide the bonding surface. In one alternative, a bonding surface can be prepared chemically in conjunction or as a substitute for heat, using for example an acid to create a bonding surface on the curtain. In one embodiment, a bonding surface is configured to be placed on both sides of curtain to permit bonding of multiple sections of a rail to the curtain. An interior facing member of the rail can be attached at the bonding surface on one side of a curtain and an exterior facing member of the rail can be attached to the bonding surface on the other side of the curtain.

At 806 the metal bands are applied to the curtain over the bonding surface. In one embodiment, the metal bands form a first interior facing member and a second exterior facing member of a rail as discussed herein. In some embodiments, the metal bands are treated with an adhesive prior and/or during application. In other embodiments, the bonding surface can be treated with an adhesive and the metal bands applied. Shown in FIG. 7, is an example assembly system that can be used in conjunction with process 800. One should readily appreciate that the steps of process 800 can be repeated for each metal band applied to a curtain, alternatively, multiple bands can be applied at the same time. In some embodiments, multiple bands can be applied at the same time to prepared bonding surfaces on the curtain. In some assembly systems, multiple heating elements can be employed permitting multiple bonding surfaces to be generated on the curtain at the same time.

The metal bands attached to the curtain can be of varying length. Typically, a front facing metal band is used for its aesthetic look and feel in conjunction with a stiff rear facing metal band that can be used to provide for stiffness in the curtain. For example, a stainless steel metal band can be applied to the back of the curtain. One example of a stainless steel band includes a commercially available full hard, RC 40-45 #3 metal band. In another example, the stainless steel metal band is provided with a width dimension of 0.020 inches+/−0.0015 inches and a height of 0.312 inches+/−0.005 inches with an overall length that depends on the dimensions of the curtain.

Figure 9A:
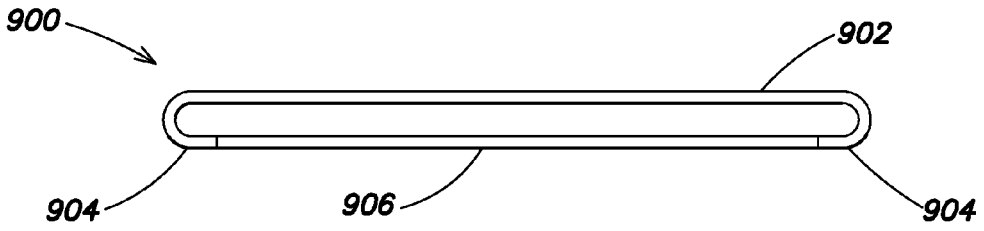
FIG. 9A illustrates an example of a rail employed in a curtain assembly, according to aspects of the present invention.

In another embodiment, the front band can be of similar and/or greater dimensions than the stiffening band. For example, the front band can be ¼ inch high, 5/16 inches high or can be constructed of a greater height dimension. In some implementations the front metal band is constructed an arranged to have an overall length greater than the width the curtain to which it is to be attached. Once the bands have been placed, the non-overlapping portion of the front metal band is wrapped around the curtain at 808. For example, the front metal band can be folded over and around the curtain under pressure. The folded over portion of the front metal band can also be configured to hold the curtain in place. Shown, in FIG. 9A, is an example of a curtain assembly having a plurality of rails (e.g. 900) made up of a front metal band 902 that can be form a first interior facing member of a rail, a folded portion 904, and a rear metal band 906 that can form a second exterior facing member of an individual rail.

Figure 9B:
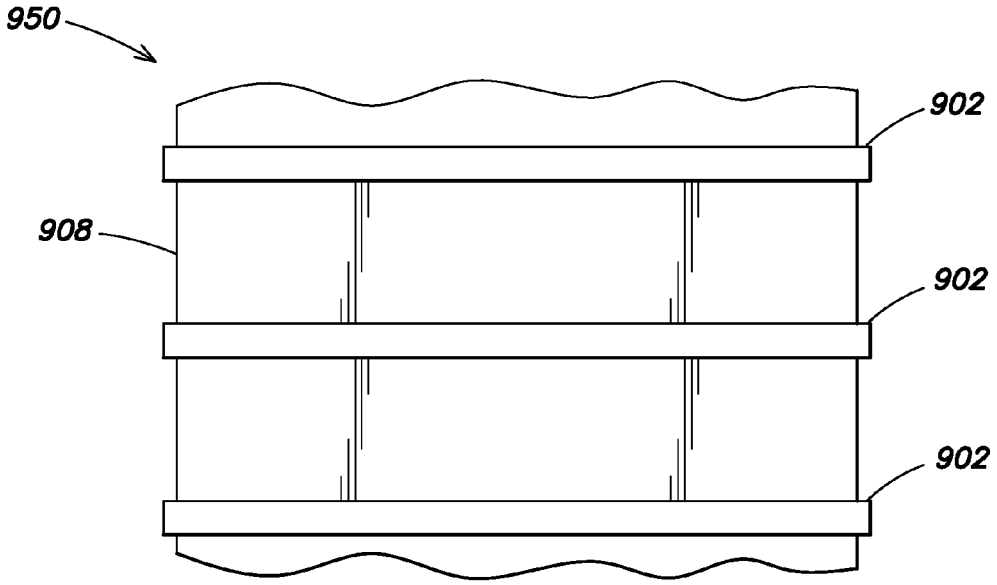
FIGS. 9B-C illustrate example views of a curtain assembly, according to aspects of the present invention.
Figure 9C:
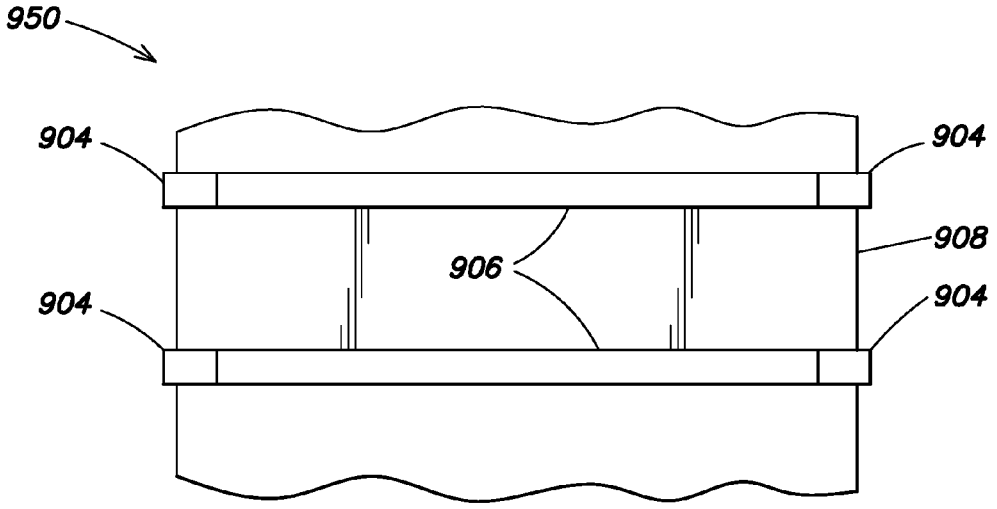

In FIG. 9B, shown is a front view of an example curtain assembly 950 with a plurality of metal bands adhered. As shown, at 902 are a plurality of metal bands, and the front metal band 902 portion of a rail can be observed adhered to a curtain 908. In FIG. 9C, shown is a rear view of the example curtain assembly 950. The front metal band forms a folded over portion at 904, which can be configured to abut the rear metal band 906. The folded over portion 904 can also be configured to fix the front metal band to the curtain 908, by pressure exerted on the curtain by the folded over portion 904. The pressure based attachment can be used in conjunction with or as a substitute for the adhesive based attachment.

Figure 10A:
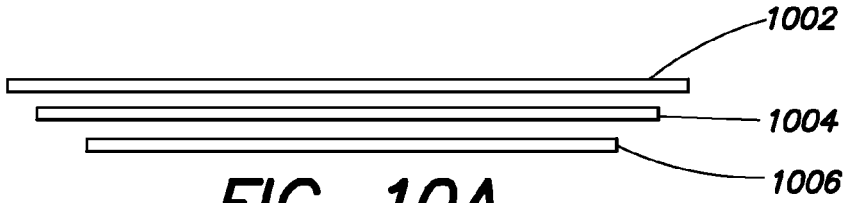
FIGS. 10A-C illustrate examples of assembly of a rail used in a curtain assembly, according to aspects of the invention.
Figure 10B:
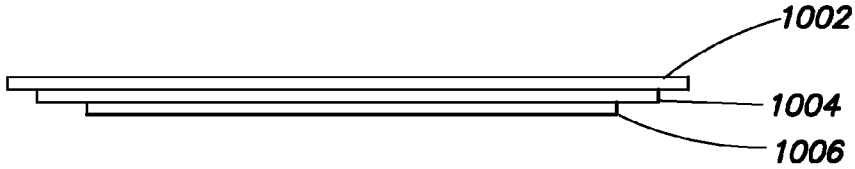
Figure 10C:
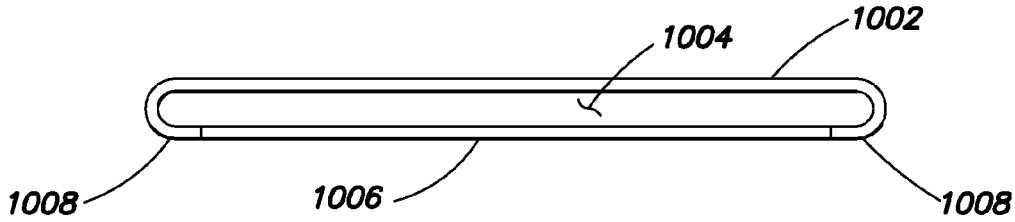

In some embodiments, the length of the front metal band is configured to provide for the folded over portion of the front metal band at 904. Further the length of the front metal band can be configured to result in the folder over portion 904 abutting the rear metal band adhered to the exterior facing side of the curtain 908. Shown in FIGS. 10A-C is an example of some metal bands prior, during, and after attachment to a curtain material. Although one should appreciate that no particular order of construction is required or intended by the illustration and description of FIGS. 10A-C. In FIG. 10A shown is a front metal band 1002 and back metal band 1006 constructed and arranged to provide stiffness/rigidity to the curtain once the two bands are affixed. The front metal band can form a first interior facing member and the rear metal band can form a second exterior facing member of an individual rail in a curtain assembly comprising a plurality of rails attached to a curtain. In some implementations, the front metal band can be selected for aesthetic reasons, and the back band 1006 selected to provide for the stiffness/rigidity of the curtain. However, one should appreciate that front band 1002 can contribute structural support to the curtain as well.

In some implementations the front metal band can be constructed and arranged of a stiff metal material such that the front metal band provides for the stiffness/rigidity in a curtain's construction. Sown in FIG. 10B, the bands 1002 and 1006 are applied to curtain 1004. In some implementations, the curtain 1004 is prepared using heating elements to create prepared surfaces to facilitate bonding of the bands to the curtain material. Adhesive can be applied to the prepared surfaces and/or the metal bands to attach the bands to the curtain. Various adhesives can be used, and in one example, an adhesive tape is applied to the prepared surface.

In some examples, bands 1002 and 1006 are bonded to curtain material 1004 using an adhesive. The bands can be treated with an adhesive, and the bands applied to prepared locations on the curtain (not shown). In other embodiments, the curtain and/or a prepared surface of the curtain is treated with an adhesive prior to and/or in conjunction with fixing the bands 1002 and 1006 to the curtain material 1004.

FIG. 10C illustrates folding of band 1002 to provide addition security of the band 1002 to the curtain material 1004. Curved section 1008 creates pressure on curtain material 1004 that assists in holding the curtain material in place. In some embodiments, the curved sections at 1008 assist in providing rigidity to the curtain as well. In some embodiments, bands 1002 and 1006 are constructed an arranged to meet once band 1002 has been folded over. Although in some implementations spacing between the bands can be employed. In some embodiments, addition attachments can be used to attach the rear metal band to the front metal band. For example a collar or sleeve can be employed to join the rear and front metal bands.

Figure 11A:
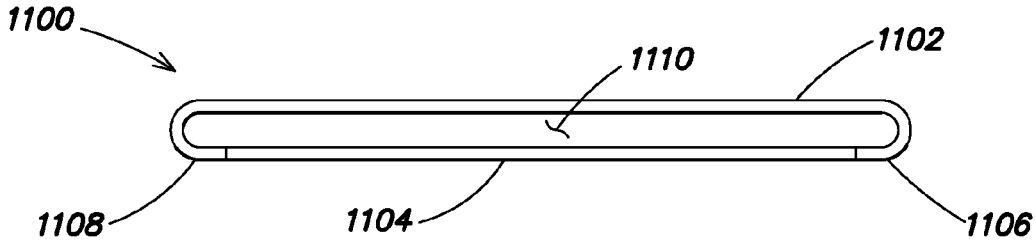
FIGS. 11A-B illustrate an example rail configured for use in a curtain assembly, according to aspects of the present invention.

Shown in FIG. 11A is an example of a rail 1100 configured for used in a curtain assembly. The curtain assembly can be constructed of a curtain and a plurality of rails that provide for the rigidity of the curtain in an installed position. Shown at 1102 is an interior facing member of the rail 1100. Typically the interior facing member can be constructed of a ductile metal. In some embodiments, the metal selected can be capable of being folded over itself. In some examples, the metal selected for interior facing member can include gold, silver, copper, and aluminum and alloys of each. As shown at 1106 and 1108 the interior member has been folded over into a first and second folded section. The rail 1100 further comprises a second exterior facing member 1104. The first interior facing member and the second exterior facing member are both attached to curtain 1110. In some examples, the second exterior member is constructed and arranged to abut the first interior facing member at the first and second folder sections 1106-1108. In some embodiments, there can be space between the second exterior member and the first and second folder sections 1106-1108 when installed. In some alternatives, attachment devices can be used to couple the first interior facing member and the second exterior facing member. For example, a sleeve can be fitted around the first interior facing member and the second exterior facing member, which can be, for example, compressed to attach the members. In another example, a weld or other adhesive could be employed.

Figure 11B:
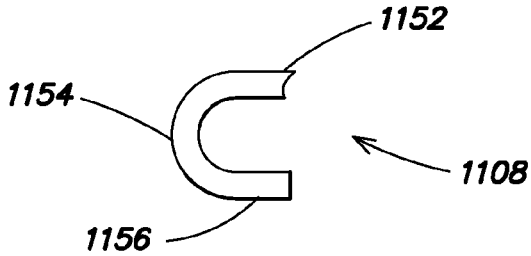

FIG. 11B shows a first folded portion 1108 of the interior facing member 1102 in greater detail. The first folded portion includes an interior flat portion 1152, a rounded portion 1154, and an exterior flat portion 1156. The interior flat portion 1152 and the exterior flat portion 1156 are constructed to compress a curtain between the interior flat portion 1152 and the exterior flat portion 1156. In some embodiments, the rounded portion can serve additional functions, for example, preventing the curtain assembly from catching on abutting surface during normal operation.

One should appreciate that the present invention is not limited in its application to the details of construction and the arrangement of components set forth in the foregoing description or illustrated in the drawings. In particular, the description of rails and components using interior and exterior is intended only to designate that the structures are placed on opposite sides, and that one of skill in the art would be readily capable of reversing the positioning of the structure with respect to a curtain. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only, and the scope of the invention should be determined from proper construction of the appended claims, and their equivalents.

What is claimed is:

1. A curtain assembly comprising:

a curtain panel having a first and a second side, wherein the first and the second side are separated by a thickness of the curtain panel, the curtain panel selectably moveable between an open position and a recessed position; and a plurality of rail assemblies attached to the curtain panel, wherein the plurality of rail assemblies are constructed and arranged to provide lateral stability in the curtain panel when the curtain panel is in an open position, and wherein the plurality of rail assemblies further comprise;

a first member, wherein a portion of the first member is attached to the first side of the curtain panel, the first member constructed and arranged to include a first and second folded portion, wherein the first and second folded portion comprise, respectively:

an interior flat portion positioned on the first side of the curtain panel, an exterior flat portion positioned on the second side of the curtain panel, a rounded portion connecting the interior fiat portion and the exterior flat portions, wherein the curtain panel having the thickness is compressed between the respective interior flat portions and the respective exterior flat portions of the first and second folded portions, and a second member positioned between the respective exterior flat portions of the first and the second folded portions.

2. The curtain assembly of claim 1, wherein the first member and the second member of the plurality of rail assemblies is attached to the curtain panel using an adhesive.

3. The curtain assembly of claim 1, wherein the second member of the plurality of rail assemblies is configured to abut the first and second folded portions of the first member.

4. The curtain assembly of claim 1, wherein the curtain panel further comprises a plurality of bonding surfaces configured for attachment to the plurality of rail assemblies.

5. The curtain assembly of claim 4, wherein the curtain panel is melted to form the plurality of bonding surfaces.

6. The curtain assembly of claim 1, wherein the first member of the plurality of rail assemblies is constructed and arranged of a length exceeding the width of the curtain panel.

7. The curtain assembly of claim 6, wherein the exterior flat portion and at least part of the rounded portion are defined by a portion of the length of the first member that exceeds the width of the curtain panel.

8. The curtain assembly of claim 1, wherein the second member of the plurality of rail assemblies is attached to the first member.

9. The curtain assembly of claim 8, including a coupling device configured to attach the second member and the first member.

10. The curtain assembly of claim 1, further comprising a roller attached to the curtain panel, wherein the roller is constructed and arranged to rotate thereby transitioning the curtain panel between the open position, wherein the curtain panel is extended from the roller and the recessed position, wherein the curtain panel is wound around the roller.

11. The curtain assembly of claim 10, wherein the plurality of rail assemblies are constructed and arranged to include a spacing between each of the plurality of rail assemblies, wherein the spacing is configured to minimize the overlap of each of the plurality of rail assemblies when the curtain panel is wound around the roller in the recessed position.

12. The curtain assembly of claim 10, wherein the curtain panel further comprises a plurality of bonding surfaces configured for attachment of the plurality of rail assemblies, wherein the plurality of bonding surfaces are constructed and arranged to include a spacing between each of the plurality of bonding surfaces, wherein the spacing is configured to minimize the overlap of each of the plurality of rail assemblies when the curtain panel is wound around the roller into the recessed position.

13. The curtain assembly of claim 10, wherein the roller is constructed and arranged with mating surfaces, wherein the mating surfaces are constructed and arranged to mate with the plurality of rail assemblies when the curtain panel is in the recessed position.

14. The curtain assembly of claim 1, wherein the first member and second member of the plurality of rail assemblies are constructed of metal.

15. The curtain assembly of claim 14, wherein the first member is constructed and arranged of a ductile metal.

16. The curtain assembly of claim 14, wherein the second member of the plurality of rail assemblies is constructed to provide the lateral stability in the curtain panel when the curtain panel is in the open position.

17. The curtain assembly of claim 16, wherein the second member of the plurality of rail assemblies is constructed to provide substantially all of the lateral stability in the curtain panel when the curtain panel is in the open position.

18. The curtain assembly of claim 16, wherein the first member is constructed and arranged to provide substantially no lateral stability to the curtain panel.

* * * * *